United States Patent [19]

Biancardi

[11] Patent Number: 4,759,195

[45] Date of Patent: Jul. 26, 1988

[54] ENERGY SAVING SELF-POWERED INDUSTRIAL DEHUMIDIFIER

[76] Inventor: Robert P. Biancardi, 6929 Northcote, Hammond, Ind. 46324

[21] Appl. No.: 7,932

[22] Filed: Jan. 28, 1987

[51] Int. Cl.[4] ..... F25B 5/00

[52] U.S. Cl. ..... 62/283; 62/275; 62/272

[58] Field of Search ..... 62/272, 260; 165/45; 126/362

[56] References Cited

U.S. PATENT DOCUMENTS

| | | | |
|---|---|---|---|
| 920,557 | 5/1909 | Fleming | 62/260 |
| 1,944,992 | 1/1934 | Miller | 62/260 X |
| 1,945,441 | 1/1934 | Miller . | |
| 2,030,032 | 2/1936 | Keyes . | |
| 2,069,359 | 2/1937 | Dudley . | |
| 2,085,964 | 7/1937 | Fonda . | |
| 2,333,309 | 11/1943 | Gould . | |
| 2,548,665 | 4/1951 | Grant . | |
| 2,737,027 | 3/1956 | Kleist . | |
| 2,872,858 | 2/1959 | Caldewell . | |
| 3,102,399 | 9/1963 | Meckler . | |
| 3,521,460 | 7/1970 | Knowles . | |
| 4,294,083 | 10/1981 | King . | |
| 4,375,831 | 3/1983 | Downing, Jr. | 62/260 X |

*Primary Examiner*—Henry A. Bennet

[57] ABSTRACT

A dehumidifier for use in an industrial or commercial building in conjunction with an air conditioning system is provided which utilizes the natural coolness of tap water to condense water vapor from the air. The tap water line is diverted into a heat exchanger upstream of the air conditioner evaporator coils to dehumidify the air and remove the latent heat given off during condensation to reduce the work load on the air conditioning system.

15 Claims, 1 Drawing Sheet

10
12
14
16
18
20
22
24
26
28
30
32
34
36
38
40
42
44
46
48
50
52
54
56
58
60
62
64
66
68
70
71
72
73
74
76
78

ENERGY SAVING SELF-POWERED INDUSTRIAL DEHUMIDIFIER

BACKGROUND OF THE INVENTION

1. Field of the Invention

The present invention relates to dehumidifiers and more particularly to a dehumidifier to be used in conjunction with an industrial or commercial size air conditioning system.

2. Description of the Prior Art

Presently available industrial or commercial sized air conditioning systems perform the dual function of reducing the moisture level of the air as well as the temperature level of the air as the air is passed over the evaporator coils. Energy is supplied to this system through the use of a condensor to effect both the temperature reduction as well as the moisture reduction. The moisture reduction is accomplished by condensing moisture out of the air by maintaining the temperature of the evaporator coils below the dew point of the incoming air. As the moisture condenses on to the coils, heat is given off which is absorbed by the refrigerant in the coils, which heat must be removed by an energy input at the condensor.

Some air conditioning systems provide a means for removing moisture from the air prior to it contacting the evaporator coils, such as the use of a separate dehydrator as disclosed in U.S. Pat. No. 1,945,411 which is defined as being a desiccant material which must be periodically heated in order to remove the absorbed moisture. This requires the addition of energy to the system. Further, the air leaving the dehydrator is elevated in temperature thus requiring the cooler to do more work.

SUMMARY OF THE INVENTION

The present invention utilizes a presently untapped, yet readily available and virtually free energy source to do the work of dehumidifying the air prior to passage of the air over the evaporator coils. This untapped energy source is the virtually constant flowing water supply line to an industrial or commercial building which has the capacity to absorb a large amount of heat from the incoming air sufficient to reduce the temperature below the dew point and to thereby condense the moisture from the air, thus relieving this energy burden from the evaporator coils.

Since large commercial and industrial buildings, such as hospitals, office buildings and factories have a constant usage of tap water, the water in the incoming water line will be constantly moving, thus providing a continuous source of relatively cold water to act as a refrigerant to provide the dehumidification. The continuously moving water will absorb the heat given off by the water vapor as it condenses thus preventing the air leaving the dehumidifier coil from being at an elevated temperature and thus avoiding the increased burden to the evaporator coil which is present in previously disclosed predehumidifying apparatus.

In most commercial and industrial buildings the "coolness" of the cold water is not critical and in most modern buildings any special usages of cold water, such as drinking fountains, now employ a separate chiller to reduce the temperature of the water used for those purposes to a specific desired level. The bulk of the water is used for washing, rinsing, cooking or similar usages in which the temperature of the water is not critical and often times is even caused to be heated further prior to usage either at a central hot water heater, or at a point of utilization. Therefore, an increase in the temperature of the water flowing through the incoming water main will not have any net energy costs associated with it and may provide some additional energy savings in that more water is heated than is cooled in normal commercial or industrial usage and so if the temperature of the incoming water is elevated slightly, less energy will be required to further elevate it to the desired final temperature.

It is contemplated by the present invention that the incoming water line can be selectively diverted through a finned tube heat exchanger which may be placed in the outside air intake duct for a number of different air conditioning units. In this manner, all of the incoming air will be dehumidified prior to reaching the evaporator coils of the air conditions. The tap water may also be selectively caused to bypass the heat exchanger coil if the humidity of the air is low or if the temperature of the tap water is above the dew point thus rendering the water ineffective in removing moisture.

A drain is provided for directing the condensed water vapor to an appropriate discharge point and a meter can be utilized in the drain to measure the amount of water collected and thus the effectiveness of the tap water dehumidifying apparatus.

DESCRIPTION OF THE PREFERRED EMBODIMENTS

Figures 1, 2:
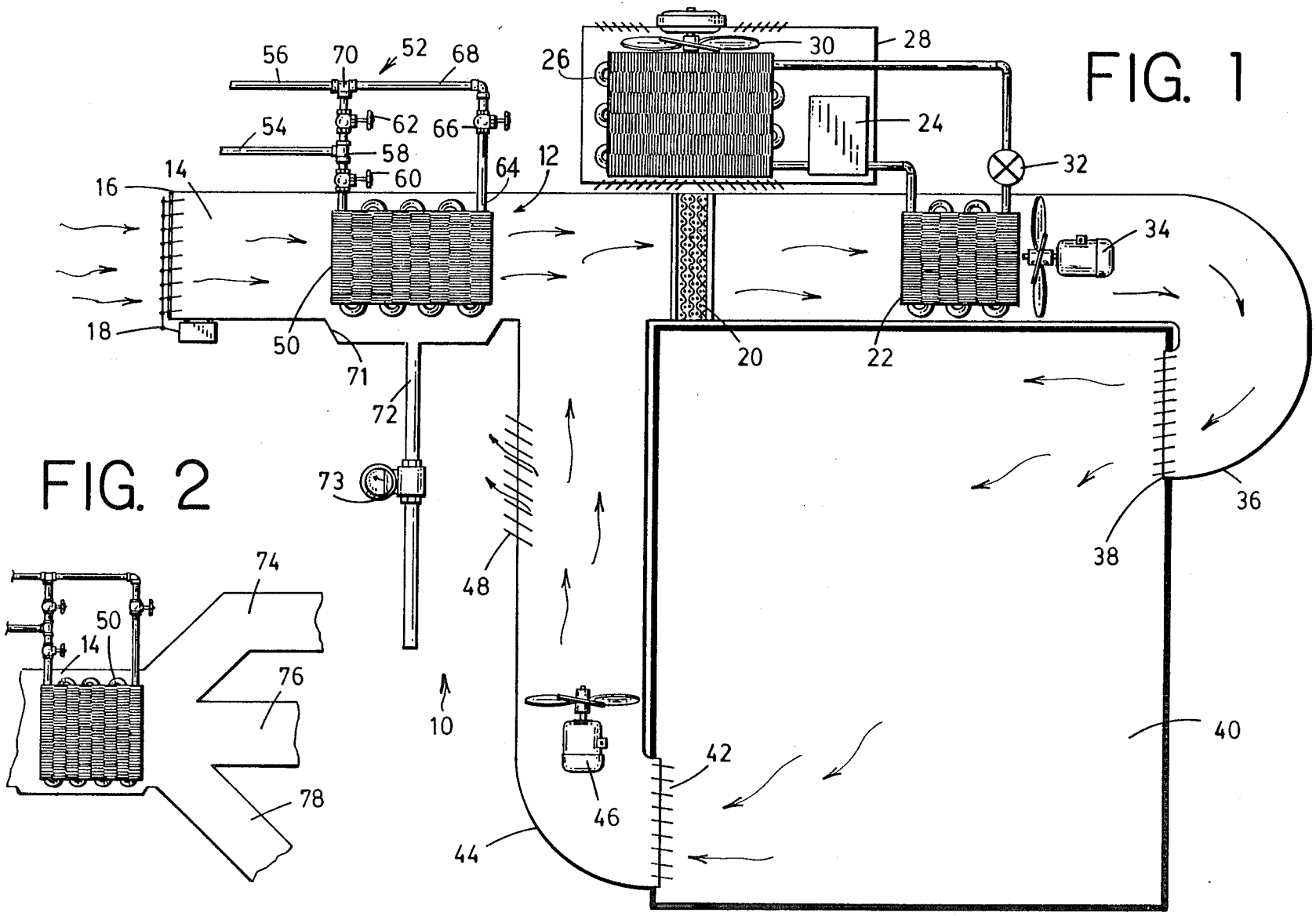
FIG. 1 is a schematic sectional view of an air conditioning system including a dehumidifier apparatus incorporating the principles of the present invention.
FIG. 2 is a schematic sectional view taken 90° to that of FIG. 1 illustrating the use of a single dehumifying apparatus for a plurality of air conditioning systems.

In FIG. 1 there is illustrated an air conditioning system generally at 10 which includes a dehumidifying apparatus 12 placed within an air intake conduit 14 which has an open end 16 exposed to outside atmosphere. The open end 16 has a controllable louvered shutter arrangement 18 to control the amount of air being drawn into the air conditioning system. Other types of air inlet arrangements could be utilized.

The air conditioning system also includes an air filtering device 20 through which fresh air as well as recirculated air must pass before it passes over an air cooling device 22 which is a series of finned evaporator coils through which a refrigerant flows. The evaporator coils are connected to a compressor 24 which is in turn connected to a series of finned condensor coils 26 positioned within a housing 28 containing an air moving means 30 such as a motor driven fan. The output of the condensor coils 26 flows through an expansion valve 32 to the evaporator coils 22.

The air is drawn over the evaporator coils 22 by means of a motor driven fan 34 and is directed by appropriate conduits 36 and vent openings 38 into an area 40 of the commercial or industrial building to be cooled. The air which picks up heat within the area 40 to be cooled is exhausted through exhaust outlets 42 and through appropriate duct work 44, being drawn by an additional motor driven fan 46 to be mixed with fresh inlet air. An exhaust vent 48 is positioned in the return air duct 44 so that a desired amount of fresh air may be drawn into the building.

The dehumidifying apparatus 12 which incorporates the principles of the present invention, is positioned in the fresh air duct 14 and comprises a series of finned coils 50 over which the fresh air passes. The coils are attached to piping 52 including an inlet pipe 54 and a discharge pipe 56. The inlet pipe 54 is connected by means of a T valve 58 to a first valve 60 and a second valve 62. The first valve 60 is positioned between the T junction 58 and the evaporator coils 50. The second valve 62 is positioned between the T valve 58 and the discharge piping 56. A second end 64 of the dehumidifier coil 50 is connected to a third valve 66 which then connects by way of piping 68 to a T junction 70, one leg of which is connected to the discharge piping 56 and the other leg of which is connected to the second valve 62.

The inlet piping 54 is connected to the water supply line or water main through which tap water for the building is supplied. The discharge pipe 56 is also connected to the tap water line, the line being broken between the points of connection of pipings 54 and 56 such that all, or a valved portion of the tap water is directed into the inlet piping 54 and is returned to the building water lines through discharge piping 56.

When the dehumidifier apparatus 12 is in operation, valves 60 and 66 are opened while valve 62 is closed. This causes all of the water flowing in through inlet piping 54 to flow through the dehumidifier coil 50 and then out through discharge piping 56. When it is desired to take the dehumidifier coil 50 out of operation, then valves 60 and 66 are closed while valve 62 is open. This then causes the water to flow in through inlet piping 54 and to bypass the evaporator coils 50 by flowing through valve 62 and then out through discharge piping 56. Intermediate flows of less than all of the inflowing tap water can be effected by partially opening both valve 60 and valve 62.

In order to effect a dehumidification of the air by flowing tap water through the fin coils 50, the water has to be below the dew point of the air. As an example, the tap water in the Chicago area during the summer of 1985 ranged from 51° F. to 71° F. with an average of 61° F. An average temperature of 61° F. would be below the dew point temperature of air 70° F. or above with a relative humidity of 42% or above. As the air temperature rises, the relative humidity percentage at a specific dew point temperature would drop. That is, at an ambient air temperature of 85° F., the dew point temperature of 61° F. corresponds to a relative humidity of approximately 22%. Thus, the tap water would be effective to condense moisture out of the air as its being drawn into an air conditioning system in a commercial or industrial building.

It is necessary that this dehumidifier apparatus be placed in a commercial or industrial building in that it is these building that have virtually constantly running tap water lines. Thus, there would be a continuous flow of water through the dehumidifier coils 50 to absorb the latent heat given off during condensation of the water vapor from the air so that the temperature of the coils would remain below the dew point.

Again as an example, a building which utilizes 2.4 million gallons of water a month, which is the amount of water usage experienced by a local hospital, and assuming a 10° rise in the tap water temperature during the dehumidifying process, would result in 192 million B.T.U., or 56 million watts of energy being available on a monthly basis to do the work of condensing the water vapor from the air.

Postioned below the dehumidifying coil 50 is a condensate collection trough 71 which serves to direct the condensed water vapor to a drain pipe 72. A flow meter 73 can be placed in the drain pipe 72 to provide a visual indication of the amount of water vapor being extracted from the air as a means of determining the energy savings of the apparatus as well as providing a visual indication of whether or not the valves 60, 62, 66 should be opened or closed. That is, if the flow meter shows a zero flow of condensate through the drain pipe, then the valves could be changed to cause the tap water to bypass the dehumidifying coil since the flow of water through the coils would be ineffective in removing moisture.

FIG. 2 illustrates that the dehumidifying coil 50 may be placed in the air intake conduit 14 and, downstream of the dehumidifying coil 50, the air stream may be split into a plurality of air streams by separate ducts 74, 76 and 78, each of the ducts being connected to a different air cooling apparatus. Thus, a single dehumidifying apparatus may be used for a plurality of air cooling devices in the building.

Thus, a substantially free or low energy cost arrangement, which does not require additional pumps or other powering equipment, is provided to absorb the latent heat of water vapor from the air and to thereby dehumidify the air prior to being cooled by a conventional air conditioner. This previously unused, but readily available source of energy can effect a substantial savings in the operation of the air conditioning system.

It will be appreciated that automatic controls can be applied to the valves to selectively open or close the valves depending upon the temperature and humidity conditions of the air as well as the incoming water in order to automatically cause the water to flow throught the dehumidifying apparatus when the water temperature is below the dew point temperature of the ambient air and to cause the water to bypass the dehumidifying apparatus when the water temperature is above the dew point temperature of the air.

As is apparent from the foregoing specification, the invention is susceptible of being embodied with various alterations and modifications which may differ particularly from those that have been described in the preceeding specification and description. It should be understood that I wish to embody within the scope of the patent warranted hereon all such modifications as reasonably and properly come within the scope of my contribution to the art.

I claim as my invention:

1. An energy saving self-powered industrial dehumidifier for use in a building having a tap water conduit leading from a source of supply to a plurality of utilization points comprising:

a dehumidifying apparatus positioned in a stream of air to be dehumidified in said building;

said dehumidifying apparatus comprising conduit means for diverting at least a portion of a relatively continuously moving stream of tap water from said tap water conduit through a heat exchanger positioned in a stream of air and returning said diverted portion to said tap water stream upstream of said utilization points;

whereby, water vapor in said stream of air will condense onto said heat exchanger when said tap water has a temperature below a dew point temperature of said air stream, thereby dehumidifying said air stream.

2. A dehumidifier according to claim 1, wherein said conduit means includes valve means for causing said tap water stream to bypass said heat exchanger.

3. A dehumidifier according to claim 1, wherein said heat exchanger comprises a fin-on-tube heat exchanger.

4. A dehumidifier according to claim 1 including a condensate collection device and a connected drain conduit to direct condensed water vapor away from said air stream.

5. A dehumidifier according to claim 4 including a flow meter in said drain conduit to provide a visual indication of the amount of water vapor being condensed.

6. An air conditioning system comprising:

a building having a source of tap water;

conduit means for directing a stream of tap water to utilization outlets within the building;

an air cooling apparatus;

duct means for directing a stream of air to said air cooling apparatus and from said apparatus to a space within the building to be cooled;

a dehumidifying apparatus positioned in said stream of air to remove water vapor from said air;

said dehumidifying apparatus comprising conduit means for diverting at least a portion of said stream of tap water through a heat exchanger positioned in said stream of air and for returning said portion to said tap water stream upstream of said utilization outlets;

whereby, water vapor in said stream of air will condense onto said heat exchanger when said tap water has a temperature below a dew point temperature of said air stream thereby dehumidifying said air stream.

7. An air conditioning system according to claim 6, wherein said conduit means includes valve means for causing said tap water stream to bypass said heat exchanger.

8. A dehumidifier according to claim 6, wherein said heat exchanger comprises a fin-on-tube heat exchanger.

9. A dehumidifier according to claim 6 including a condensate collection device and a connected drain conduit to direct condensate water vapor away from said air stream.

10. A dehumidifier according to claim 9 including a flow meter in said drain conduit to provide a visual indication of the amount of water vapor being condensed.

11. An air conditioning system according to claim 6, wherein said dehumidifying apparatus is positioned upstream of said air cooling apparatus.

12. An air conditioning system according to claim 11, wherein said duct means directs said air stream to a plurality of air cooling apparatus downstream of said dehumidifying apparatus.

13. An air conditioning system according to claim 6, wherein said building has an air inlet providing a source of fresh air and said duct means directs a stream of fresh air to said dehumidifying apparatus.

14. A dehumidifier according to claim 1, wherein said building includes a heating means for elevating the temperature of said tap water upstream of said utilization points and said conduit means returns said diverted portion of said tap water to said tap water stream upstream of said heating means.

15. A dehumidifier according to claim 6, wherein said building includes a heating means for elevating the temperature of said tap water upstream of said utilization outlets and said conduit means returns said diverted portion of said tap water to said tap water stream upstream of said heating means.

* * * * *